US012685906B2

(12) United States Patent
Kato et al.

(10) Patent No.: US 12,685,906 B2
(45) Date of Patent: Jul. 21, 2026

(54) GROMMET AND RACKET

(71) Applicant: YONEX CO., LTD., Tokyo (JP)

(72) Inventors: Hitoshi Kato, Niigata (JP); Hiroki Nishiyama, Niigata (JP); Koji Nagasawa, Tokyo (JP); Nao Inoue, Tokyo (JP)

(73) Assignee: YONEX CO., LTD., Tokyo (JP)

( * ) Notice: Subject to any disclaimer, the term of this patent is extended or adjusted under 35 U.S.C. 154(b) by 442 days.

(21) Appl. No.: 18/273,404

(22) PCT Filed: Jan. 19, 2022

(86) PCT No.: PCT/JP2022/001737
§ 371 (c)(1),
(2) Date: Jul. 20, 2023

(87) PCT Pub. No.: WO2022/163454
PCT Pub. Date: Aug. 4, 2022

(65) Prior Publication Data

US 2024/0091597 A1 Mar. 21, 2024

(30) Foreign Application Priority Data

Jan. 29, 2021 (JP) ..... 2021-012755

(51) Int. Cl.
*A63B 49/022* (2015.01)
*A63B 102/02* (2015.01)

(52) U.S. Cl.
CPC ..... *A63B 49/022* (2015.10); *A63B 2102/02* (2015.10)

(58) Field of Classification Search
CPC ..... A63B 49/022; A63B 2102/02; A63B 2102/04
See application file for complete search history.

(56) References Cited

U.S. PATENT DOCUMENTS

2011/0319206 A1 12/2011 Mace et al.

FOREIGN PATENT DOCUMENTS

DE 202 20 501 2/2004
JP 56-4042 Y 1/1981
(Continued)

OTHER PUBLICATIONS

International Search Report issued in WIPO Patent Application No. PCT/JP2022/001737, dated Mar. 1, 2022, along with an English translation thereof.

(Continued)

*Primary Examiner* — Jeffrey D Carlson
(74) *Attorney, Agent, or Firm* — GREENBLUM & BERNSTEIN, P.L.C.

(57) ABSTRACT

To improve repulsion performance when a ball is hit by a racket. Grommets each include a strip-shaped portion and a cylinder portion protruding from one surface of the strip-shaped portion. The cylinder portion includes a plurality of ribs extending along an extending direction of a central axis of a cylinder main body. The plurality of ribs is constituted of first ribs protruding from an outer peripheral surface of the cylinder main body toward both sides in the extending direction of the strip-shaped portion, and second ribs protruding from the outer peripheral surface of the cylinder main body toward both sides in a direction orthogonal to the extending direction of the strip-shaped portion. Two or more of the first ribs are formed on each of the both sides in the extending direction of the strip-shaped portion, and one or more of the second ribs are formed on each of the both sides in the direction orthogonal to the extending direction of the strip-shaped portion.

3 Claims, 5 Drawing Sheets

(56) References Cited

FOREIGN PATENT DOCUMENTS

| | | |
|---|---|---|
| JP | 2012-517873 A | 8/2012 |
| JP | 2013-132455 | 7/2013 |

OTHER PUBLICATIONS

Official communication in EP 22745677.9 dated Dec. 3, 2024.

GROMMET AND RACKET

TECHNICAL FIELD

The present invention relates to a grommet mounted on a frame of a racket to avoid contact between a string and the frame, and a racket using such a grommet.

BACKGROUND ART

As disclosed in Patent Document 1, a tennis or badminton racket includes a frame formed in a loop shape, and a string is extended in a tensioned state inside the frame to form a hitting surface (face). A large number of holes through which the string is inserted are formed in the frame at predetermined intervals. A grommet is mounted in each of the holes, and a cylindrical portion (hereinafter referred to as a "cylinder portion") of the grommet is interposed between an inner peripheral surface of the hole and the string to avoid contact therebetween.

In the racket, the string is flexure-deformed when a ball is hit. Due to such flexure deformation, a force acts on the cylinder portion of the grommet to deform the cylinder portion, and a restoring force caused by the deformation of the cylinder portion acts not only on the string but also on a ball in contact with the string.

PRIOR ART DOCUMENTS

Patent Documents

Patent Document 1: Japanese National Publication of International Patent Application No. 2012-517873

Patent Document 2: Japanese Laid-open Utility Model Publication after Examination No. 56-004042

SUMMARY OF INVENTION

Technical Problem

Each hole of the frame is formed in a round hole shape, and the cylinder portion of the grommet is formed in a cylindrical shape. For convenience of an operation for inserting the cylinder portion into each hole of the frame, the hole and the cylinder portion are formed in such a way that an outer diameter of the cylinder portion is smaller than an inner diameter of the hole, and a clearance is formed between the hole and the cylinder portion. When such a clearance is formed, the cylinder portion is likely to be deformed by the size of the clearance when a force is applied to the cylinder portion due to the flexure of the string caused by a ball hit by a racket. Due to such deformation of the cylinder portion, there is a problem in that the time from the deformation of the cylinder portion to the restoration of the cylinder portion becomes long, and thus the repulsion performance of a hit ball is deteriorated.

If the outer diameter dimension of the cylinder portion is increased to reduce the clearance, the cylinder portion is less likely to be deformed when a ball is hit, but there is a problem in that the resistance of inserting the cylinder portion into each hole of the frame increases, and it is difficult to insert the cylinder portion into the hole.

In Patent Document 2, a grommet is known in which a rib is formed on a cylinder portion. Four ribs are formed at intervals of 90° in the circumferential direction of the cylinder portion. However, in Patent Document 2, the circumferential positions (rotation angles) of the cylinder portion and the rib in a hole are arbitrarily determined. A pressing force that presses the rib against the hole of the frame is applied to the rib by extending the string in a tensioned state. In the grommet of Patent Document 2, the pressing force acts on one rib, and the rib is likely to be crushed, thereby increasing the clearance between the hole and the cylinder portion. Therefore, also in the grommet of Patent Document 2, there is a problem that it is difficult to enhance the repulsion performance of a hit ball.

The present invention has been made in view of such a point, and an object of the present invention is to provide a grommet and a racket capable of improving the repulsion performance when a ball is hit by the racket.

Solution to Problem

A grommet according to an aspect of the present invention is a grommet including a strip-shaped portion extending in a predetermined direction and a cylinder portion protruding from one surface of the strip-shaped portion, the grommet being mounted on a loop-shaped frame of a racket, in which the cylinder portion includes: a cylinder main body through which a string passes in a state where the cylinder main body passes through a hole formed in the frame; and a plurality of ribs protruding from an outer peripheral surface of the cylinder main body and extending along an extending direction of a central axis of the cylinder main body, the plurality of ribs is constituted of first ribs protruding from the outer peripheral surface of the cylinder main body toward both sides in an extending direction of the strip-shaped portion and second ribs protruding from the outer peripheral surface of the cylinder main body toward both sides in a direction orthogonal to the extending direction of the strip-shaped portion, two or more of the first ribs are formed on each of the both sides in the extending direction of the strip-shaped portion in the cylinder main body, and one or more of the second ribs are formed on each of the both sides in the direction orthogonal to the extending direction of the strip-shaped portion in the cylinder main body.

A racket according to an aspect of the present invention is a racket including: the grommet including a plurality of the cylinder portions; and a frame on which the string is extended in a tensioned state in a vertical direction and a lateral direction, in which the grommet is mounted on the frame by passing the cylinder portion through a hole formed in the frame, and the string is extended in the tensioned state by passing the string through the plurality of the cylinder portions.

Advantageous Effects of Invention

According to the present invention, two or more of the first ribs can be pressed against the hole of the frame by extending the string in a tensioned state. Thus, it is possible to suppress the first rib from being crushed, and it is possible to suppress deformation of the cylinder portion when a ball is hit by a racket by making it difficult for a clearance to be created between the cylinder portion and the hole of the frame. Further, the second ribs can be formed on both sides in the direction orthogonal to the extending direction of the strip-shaped portion, in other words, on each of both sides in the front/back direction of the racket. Such second ribs can suppress deformation of the cylinder portion even when a force is applied to the cylinder portion due to flexure of the string caused by a hit ball. As described above, the first and second ribs make it difficult for the cylinder portion to be deformed when a ball is hit by a racket, and the time required for the cylinder portion to be restored to the original shape of the cylinder portion after being deformed can be shortened, thereby being capable of improving the repulsion performance of a hit ball.

BRIEF DESCRIPTION OF DRAWINGS

FIG. 1A is a front view of the racket, and FIG. 1B is a side view of the racket.

In the following, embodiments of the present invention will be described specifically with reference to the drawings. Note that in the following, an example in which a grommet according to the present invention is applied to a tennis racket or a soft tennis racket will be described, but the application of the grommet is not limited thereto and can be changed. For example, the grommet may be applied to a squash racket, a badminton racket, or the like.

Figures 1A, 1B:
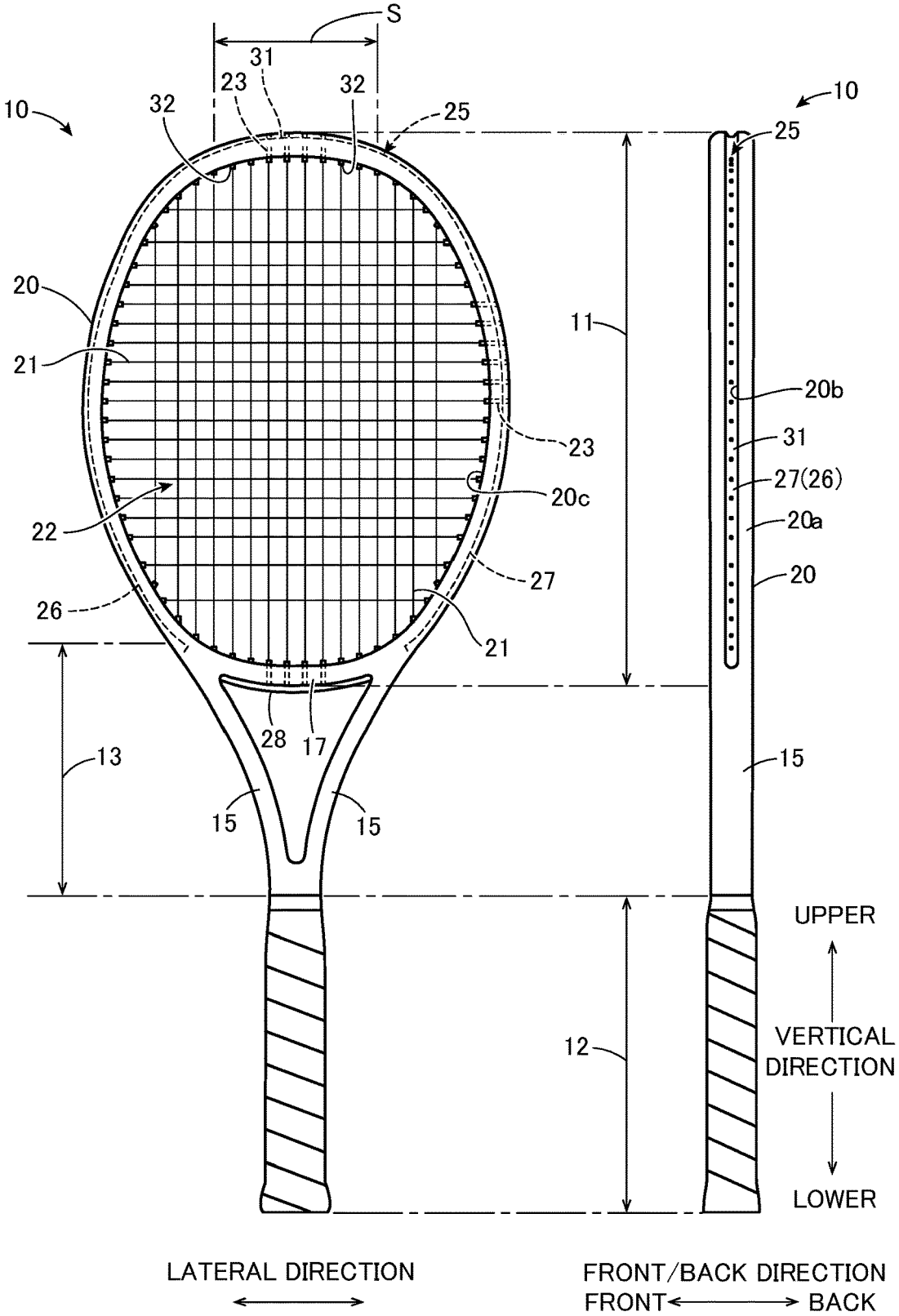
FIGS. 1A and 1B are external views of a racket according to an embodiment.

FIG. 1 is an external view of a racket according to an embodiment of the present invention, FIG. 1A is a front view of the racket, and FIG. 1B is a side view of the racket. Note that in the following drawings, some configurations are omitted for convenience of description.

As illustrated in FIG. 1, a racket 10 includes a head 11 which is a portion for hitting a ball, a grip 12 which is a portion for a player to grip the racket 10, and a shaft 13 which integrally couples the head 11 and the grip 12. Note that in the following description, as indicated by an arrow in FIG. 1, a longitudinal direction of the racket 10 is defined as a vertical direction, a side on which the head 11 is located in the vertical direction is defined as an upper side, and a side on which the grip 12 is located is defined as a lower side. A direction orthogonal to the vertical direction on a hitting surface 22 of the racket 10 (i.e., on a plane along the hitting surface 22) is defined as a lateral direction, a direction orthogonal to the hitting surface 22 of the racket 10 is defined as a front/back direction, a front side in FIG. 1A (a left side in FIG. 1B) is defined as a front side, and an opposite side thereof is defined as a back side.

The shaft 13 includes a throat 15 which is bifurcated from the grip 12 toward the head 11 when viewed from the front/back direction, and a yoke 17 which forms a part of the head 11 is formed between the throats 15 on both sides in the lateral direction (right and left in FIG. 1A). The yoke 17 forms a lower side of a frame 20 to be described later. Note that the shaft 13 is not limited thereto, and may not be bifurcated.

The head 11 includes a loop-shaped frame 20 which is an elliptical shape long in the vertical direction, and a string 21 extended in a tensioned state in the vertical direction and the lateral direction inside the frame 20. The string 21 forms a hitting surface (face) 22 on both front and back surfaces inside the frame 20. The frame 20 is obtained by forming a hollow cylindrical body made of, for example, a fiber-reinforced plastic or the like into an elliptical shape. Note that the frame 20 may be filled with a foam material instead of being hollow, or may be made of wood or metal.

An outer peripheral surface 20*a* of the frame 20 is provided with a groove portion 20*b* in which a central portion in the front/back direction is recessed as compared with both side portions. The groove portion 20*b* is provided continuously along the circumferential direction of the frame 20. The frame 20 is provided with a through-hole (hole) 23, and the through-hole 23 is formed by penetrating from the bottom side of the groove portion 20*b* of the frame 20 to an inner peripheral surface 20*c*. A plurality of the through-holes 23 is provided along the circumferential direction of the frame 20.

Figure 2:
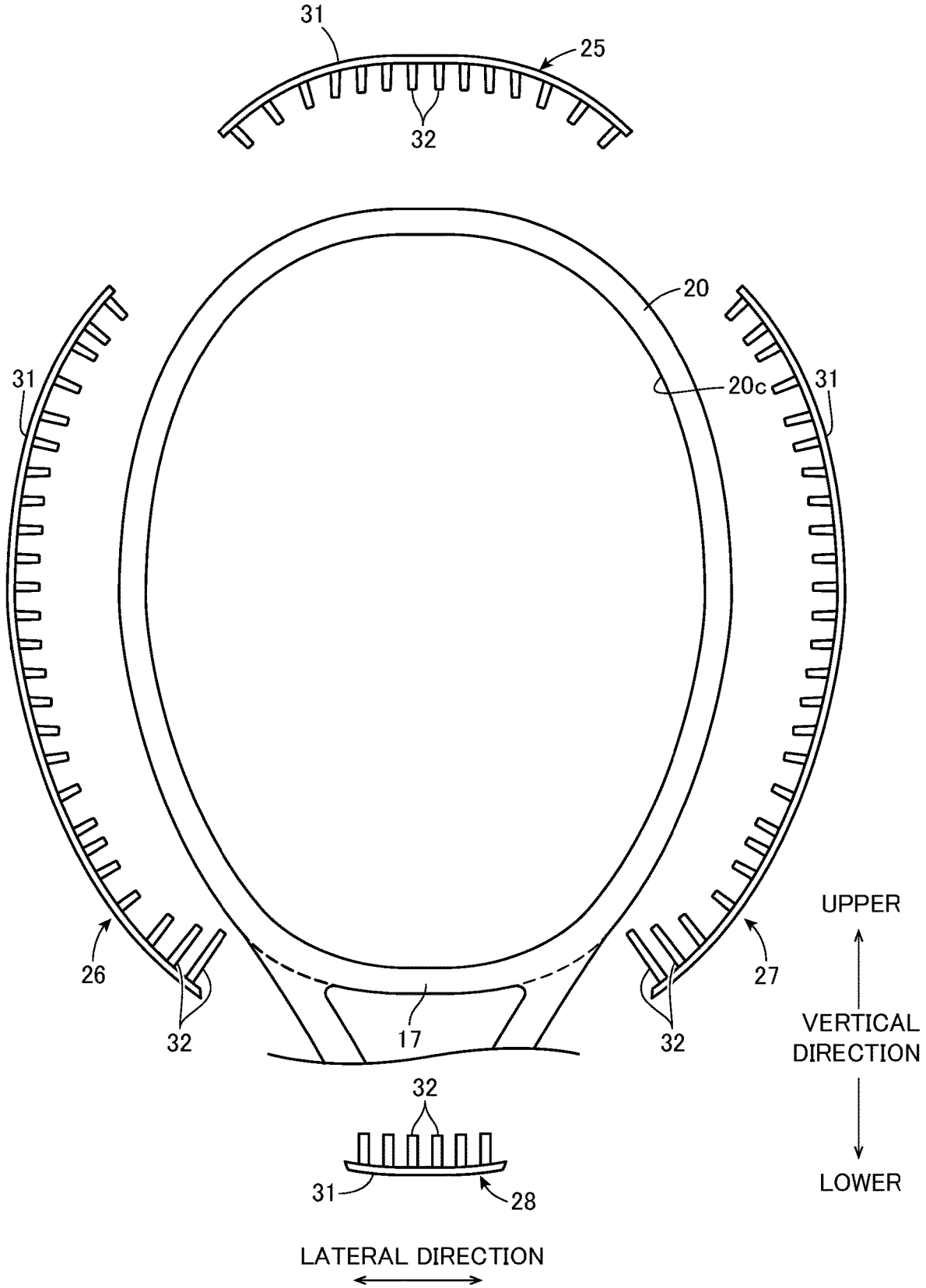
FIG. 2 is an explanatory front view of a state where a grommet is removed from a frame.

FIG. 2 is an explanatory front view of a state where a grommet is removed from the frame. As also illustrated in FIG. 2, four grommets 25 to 28 are mounted on the frame 20 from the outer peripheral side of the frame, and the string 21 is extended in a tensioned state on the frame 20 via these grommets 25 to 28. In the present embodiment, the upper grommet 25 is provided from a position in the direction of about 11 o'clock to a position in the direction of about 1 o'clock in the front view of the frame 20 in FIG. 2. The grommets 26 and 27 on both sides in the lateral direction are provided from the vicinities of both ends in the lateral direction of the upper grommet 25 to positions reaching the lowermost through-holes 23 formed on the side surfaces in the lateral direction of the frame 20. The lower grommet 28 is provided on the yoke 17. Note that the lengths of the grommets 25 to 27 except for the lower grommet 28 along the circumferential direction of the frame 20 may be changed according to various conditions.

Each of the grommets 25 to 28 may be exemplified as a molded body obtained by injection-molding a thermoplastic. Each of the grommets 25 to 28 includes a strip-shaped portion 31 extending in the circumferential direction of the frame 20 and a plurality of cylinder portions 32 protruding from one surface of the strip-shaped portion 31. The forward-backward width of the strip-shaped portion 31 is set to be larger than or equal to the forward-backward width of the groove portion 20*b* and smaller than the forward-backward width of the frame 20.

The cylinder portion 32 has a base portion on the strip-shaped portion 31 side, and a tip end portion on a side opposite to the base portion passes through the through-hole 23 from the outside of the frame 20. The grommets 25 to 28 are mounted on the frame 20 by the penetration, and in this state, the tip end side of the cylinder portion 32 is disposed so as to protrude inward from the inner peripheral surface 20*c* side of the frame 20. An inner space of each of the cylinder portions 32 is formed as an insertion path 33 (see FIG. 3) through which the string 21 is inserted. Note that an inner diameter dimension of the insertion path 33 is larger than a diameter dimension of the string 21 for convenience of workability of passing the string 21.

Figure 3:
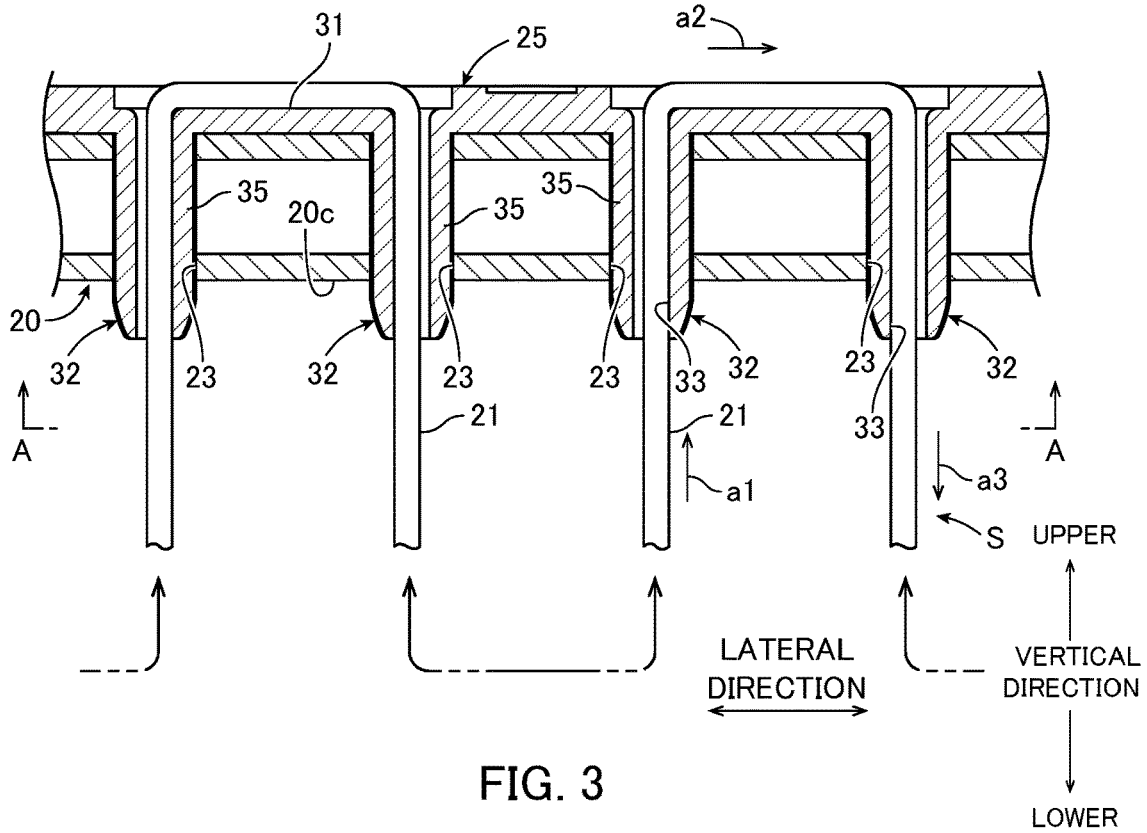
FIG. 3 is a partial front cross-sectional view of an upper portion of the racket illustrating a state of a string extended in a tensioned state in the embodiment.

A procedure for extending the string 21 in a tensioned state of the present embodiment will now be described with reference to FIG. 3. FIG. 3 is a partial front cross-sectional view of an upper portion of the racket illustrating a state of the string extended in a tensioned state in the embodiment. A description will be given of a procedure for extending the string 21 in a tensioned state in the vertical direction at the sweet spot which is the central region of the frame 20, that is, the main string 21 which serves as the warp threads in the central region S (see FIG. 1).

As illustrated in FIG. 3, when the main string 21 serving as the warp threads is extended in a tensioned state on the frame 20, the string 21 is inserted from the tip end side to the base portion side of the cylinder portion 32 when viewed from the position and direction of the arrow a1, for example. The string 21 is folded back at the base portion (one end side) of the cylinder portion 32, and is positioned and oriented in the direction of the arrow a2 along the surface of the strip-shaped portion 31 outside the frame 20. Subsequently, the string 21 is folded back at the base portion of the adjacent cylinder portion 32 in the lateral direction, is inserted from the base portion side to the tip end side of the cylinder portion 32, is positioned and oriented in the direction of the arrow a3, and is extended in the vertical direction inside the frame 20.

Such a procedure is carried out alternately on the lower side and the upper side of the frame 20 with one main string 21 forming the warp threads. Thus, the main string 21 serving as the warp threads extends in the lateral direction while meandering by being repeatedly inserted and folded back in the insertion paths 33 in the plurality of cylinder portions 32. The extending direction of the string 21 including the directions of the arrows a1 to a3 at this point is the stringing direction of the string 21.

A description will now be given of a specific configuration of the cylinder portion 32 in the upper grommet 25, that is, a specific configuration of the cylinder portion 32 through which the main string 21 serving as the warp threads in the central region S (see FIG. 1) is inserted. As illustrated in FIG. 3, the cylinder portion 32 includes a cylinder main body 35 through which the string 21 passes in a state where the cylinder main body passes through the through-hole 23 of the frame 20.

Figure 4:
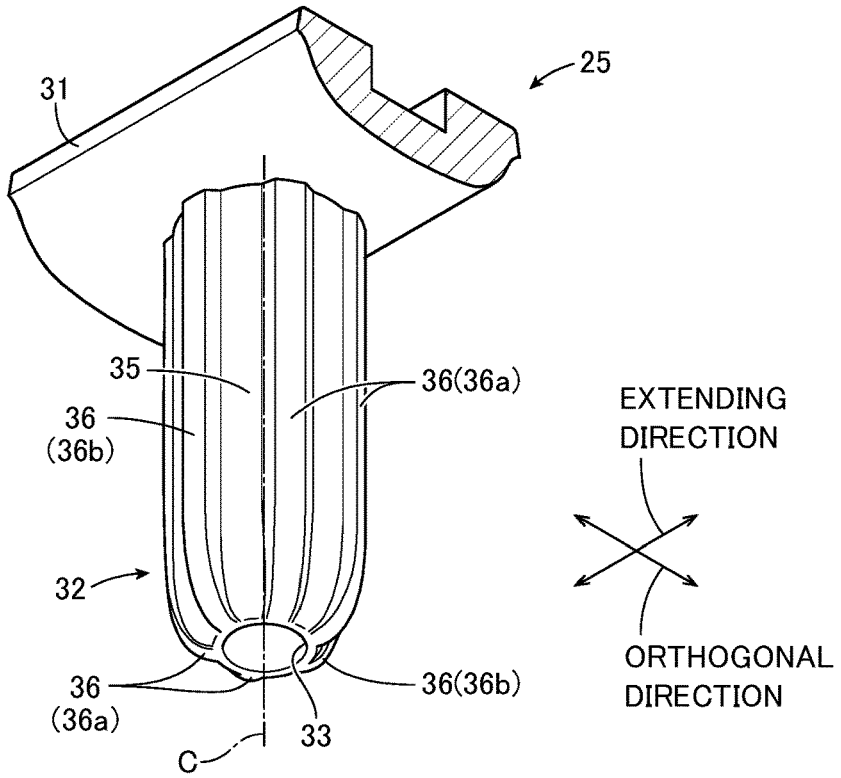
FIG. 4 is a partially enlarged perspective view of the grommet in the embodiment.
Figure 5:
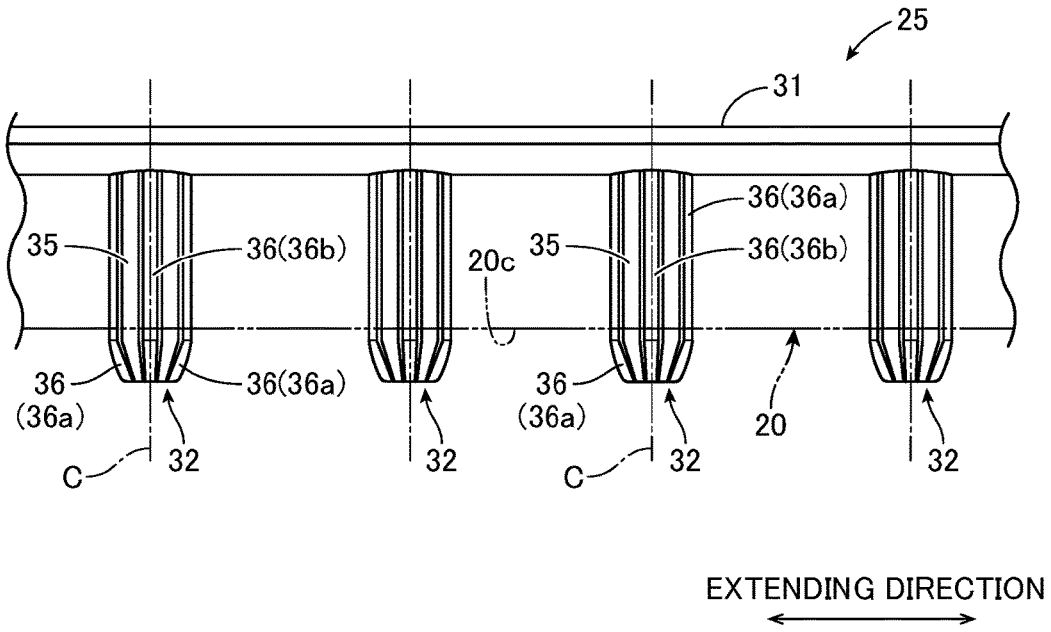
FIG. 5 is a partial front view of the grommet in the embodiment.

FIG. 4 is a partially enlarged perspective view of the grommet in the embodiment. FIG. 5 is a partial front view of the grommet in the embodiment. As illustrated in FIGS. 4 and 5, the cylinder portion 32 includes, in addition to the cylindrical cylinder main body 35, a plurality of ribs 36 formed by protruding from the outer periphery of the cylinder main body 35. The cylinder main body 35 is formed in a shape in which the tip end side is gradually narrowed.

The rib 36 extends along the extending direction of the central axis C of the cylinder main body 35, and is formed to have the same length as the cylinder main body 35 in the extending direction. As illustrated in FIG. 5, the tip end side of the cylinder main body 35 protrudes inward from the inner peripheral surface 20*c* side of the frame 20. Therefore, the rib 36, which has the same length as the cylinder main body 35, is formed to have a length protruding inward from the inner peripheral surface 20*c* of the frame 20. Thus, the rigidity improvement effect by the rib 36 can be obtained in the entire length direction of the cylinder portion 32.

Figure 6:
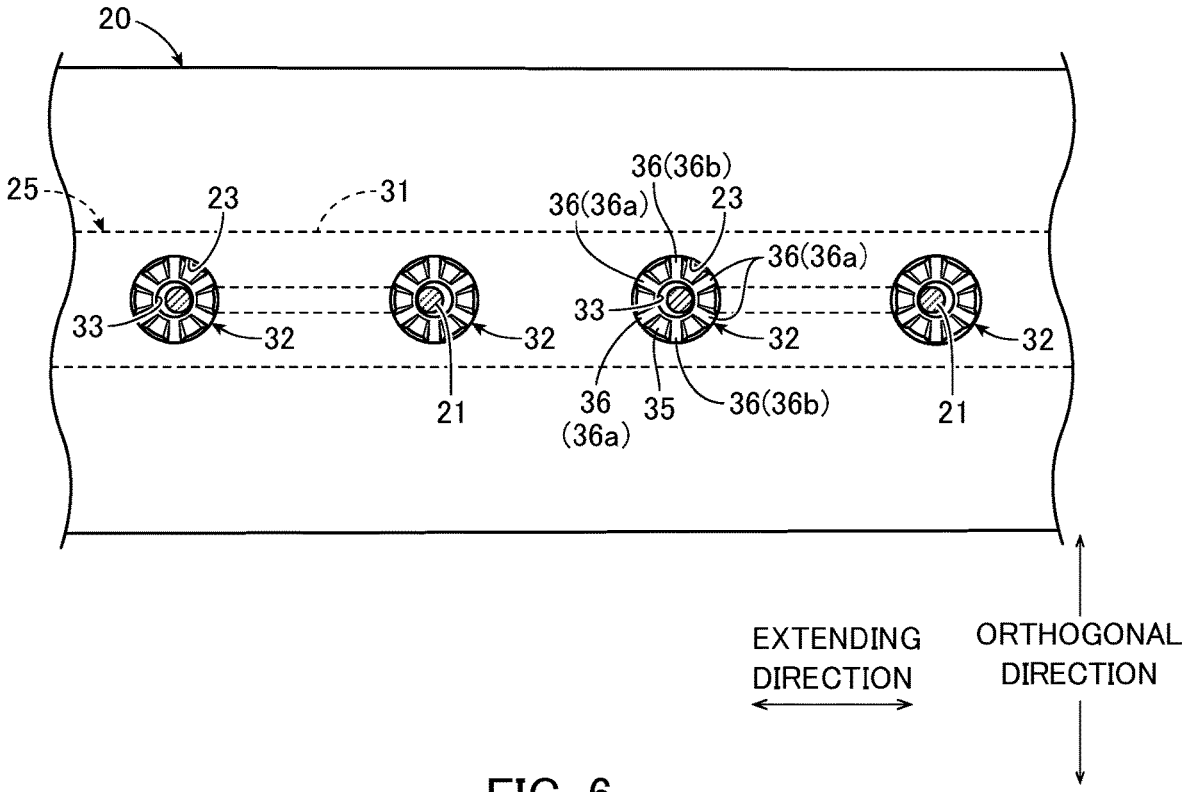
FIG. 6 is a cross-sectional view taken along line A-A of FIG. 3.

FIG. 6 is a cross-sectional view taken along line A-A of FIG. 3. As illustrated in FIG. 6 in addition to FIG. 4, the ribs 36 are formed at equal angular intervals in the circumferential direction of the cylinder main body 35, and in the present embodiment, six ribs 36 are formed at intervals of 60° in the circumferential direction of the cylinder main body 35.

Figure 7:
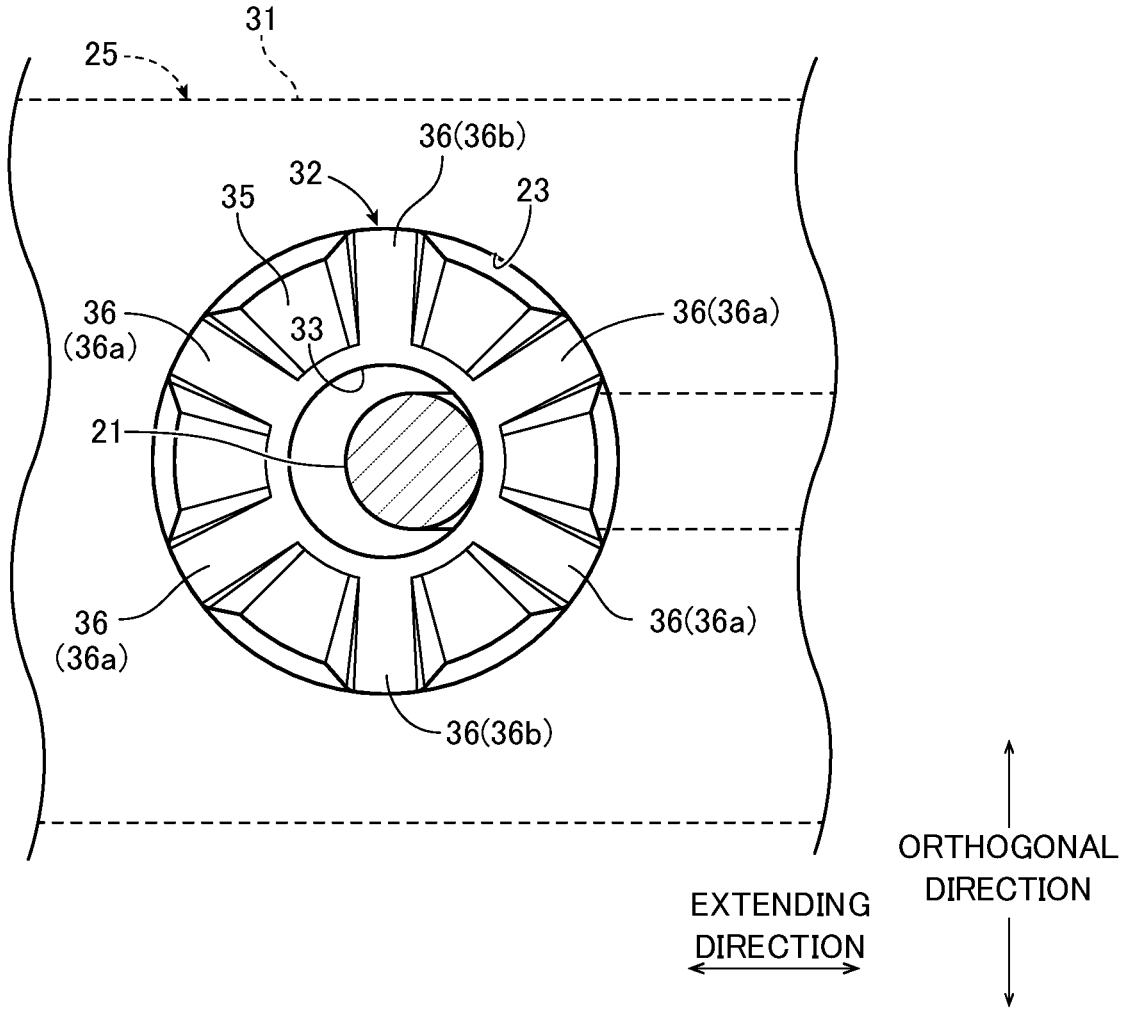
FIG. 7 is a partially enlarged view of FIG. 6.

FIG. 7 is a partially enlarged view of FIG. 6. As also illustrated in FIG. 7, the six ribs 36 protrude from the outer peripheral surface of the cylinder main body 35 in the cylinder portion 32. In the description of the protruding direction of the rib 36, the extending direction of the strip-shaped portion 31, which is the left-right direction in FIGS. 6 and 7, may be simply referred to as an "extending direction". The extending direction coincides with the extending direction of the loop forming the frame 20 in a state where the grommet 25 is mounted on the frame 20. In the description of the protruding direction of the rib 36, a direction (upper-lower direction in FIGS. 6 and 7) orthogonal to the extending direction of the strip-shaped portion 31 may be simply referred to as an "orthogonal direction". The orthogonal direction coincides with the front/back direction of the racket 10 in a state where the grommet 25 is mounted on the frame 20.

In the cylinder portion 32, the six ribs 36 protrude from the outer peripheral surface of the cylinder main body 35 in both the extending direction of the strip-shaped portion 31 and the direction orthogonal to the extending direction. More specifically, among the six ribs 36, two ribs 36 on each side in the extending direction, that is, a total of four ribs 36 protrude from the outer peripheral surface of the cylinder main body 35 toward both sides in the extending direction, and the four ribs 36 serve as a first rib 36*a*. Among the six ribs 36, one rib 36 on each side in the orthogonal direction, that is, a total of two ribs 36 protrude from the outer peripheral surface of the cylinder main body 35 toward both sides in the orthogonal direction, and the two ribs 36 serve as a second rib 36*b*. In other words, the six ribs 36 in the cylinder portion 32 are constituted of four first ribs 36*a* and two second ribs 36*b*.

Both sides of the rib 36 in the shorter side direction are formed by tapered surfaces, and the width of the rib 36 in the shorter side direction increases toward the outer peripheral surface of the cylinder main body 35.

In a state where the cylinder portion 32 having the above-described shape is inserted into the through-hole 23 of the frame 20, each rib 36 is provided to have a shape and a size such that the tip end side in the protruding direction of each rib 36 can come into contact with the inner peripheral surface of the through-hole 23. Thus, the cylinder portion 32 can be prevented from being displaced in the radial direction in the through-hole 23. When the cylinder portion 32 is inserted into the through-hole 23 in order to mount the grommet 25 on the frame 20, the frictional resistance force to the cylinder portion 32 can be prevented from increasing, and the workability of mounting the grommet 25 can be favorably maintained.

Although the racket 10 of the present embodiment has a configuration in which each of the grommets 25 to 28 includes the plurality of cylinder portions 32, the cylinder portion 32 including the plurality of ribs 36 described above is a part thereof.

As a specific example, the cylinder portions 32 including the plurality of ribs 36 are the cylinder portions 32 through which the main string 21 serving as the warp threads is inserted. Among the cylinder portions 32, the plurality of ribs 36 may be formed on the cylinder portions 32 through which the string 21 passing through the central region S is inserted. Specifically, when the number of main string 21 serving as warp threads is 16, the plurality of ribs 36 is formed in the cylinder portions 32 through which ten warp threads (main string 21) are inserted in the upper central portion in the left-right direction (in other words, ten cylinder portions 32), and in the cylinder portions 32 through which six warp threads are inserted in the lower central portion (yoke 17) in the left-right direction (in other words, six cylinder portions 32). This is because a force is applied to the upper portion of the racket 10 and the upper cylinder portions 32 of the frame 20 are easily moved since a player often hits a ball at the upper portion of the frame 20 and it is preferable to restrict the movement of the upper cylinder portions 32. When the plurality of ribs 36 is formed on a part of the plurality of cylinder portions 32, the outer peripheral surfaces of the other cylinder portions 32 are formed by the cylindrical outer peripheral surface of the cylinder main body 35.

When the string 21 is extended in a tensioned state as described above, the stringing direction of the string 21 meanders, so that the cylinder portion 32 is pressed against the through-hole 23 in the extending direction of the strip-shaped portion 31. In this state, for example, the cylinder portion 32 illustrated in FIG. 7 is pressed to the right side in FIG. 7 by the string 21 passing through the insertion path 33 and being folded back. In the cylinder portion 32 in FIG. 7, two first ribs 36*a* are formed by protruding on the right side of the cylinder main body 35 in FIG. 7, so that the crushing deformation of the first ribs 36*a* themselves can be suppressed. Thus, it is possible to make it difficult for a clearance to be created between all of the ribs 36 and the through-hole 23.

Note that the cylinder portion 32 may be pressed to the left side contrary to FIG. 7 by the string 21 that passes through the insertion path 33 and is folded back (see FIGS. 3 and 6). Even in this case, since two first ribs 36*a* are formed by protruding from the cylinder main body 35 on both sides in the extending direction of the strip-shaped portion 31, it is possible to suppress the crushing deformation of the first ribs 36*a* themselves.

When a ball is hit by the racket 10 in the present embodiment, the string 21 extended in a tensioned state in the vertical direction receives a force in the front/back direction or the lateral direction and is flexed. By the flexure of the string 21, a force is applied to the cylinder portions 32 of the upper and lower grommets 25 and 28 to deform the cylinder portions 32, and a restoring force by the deformation acts on the string 21. Therefore, in addition to the restoring force of the flexed string 21, the restoring force of the cylinder portion 32 acts on the ball, and these forces cause the ball to be repulsively hit.

Since the four first ribs 36*a* are formed in the cylinder portion 32, it is possible to make it difficult for a clearance to be created between the cylinder portion 32 and the through-hole 23 of the frame 20 by extending the string 21 in a tensioned state. Thus, it is possible to suppress the deformation of the cylinder portion 32 when a ball is hit by the racket 10. In addition, since the second ribs 36*b* are formed by protruding from the cylinder main body 35 in a direction corresponding to the front/back direction of the racket 10, although the string 21 is largely flexed in the front/back direction by the hit ball, the deformation of the cylinder portion 32 by the force due to the flexure can also be suppressed.

As described above, in the present embodiment, since the cylinder portion 32 has the first ribs 36*a* and the second ribs 36*b*, the cylinder portion 32 is less likely to be deformed when a ball is hit by the racket 10. As a result, it is possible to shorten the time required to restore the cylinder portion 32 to the original shape of the cylinder portion after being deformed, thereby improving the repulsion performance of a hit ball and increasing the speed of a hit ball.

Since the position of the cylinder portion 32 around the central axis C can be fixed by the strip-shaped portion 31, the cylinder portion 32 can be restricted from rotating around the central axis C in the through-hole 23. Thus, it is possible to prevent the number of the first ribs 36*a* from being one or less on each of both sides in the extending direction of the strip-shaped portion 31 and to maintain the number of the first ribs to be two. Therefore, in the cylinder portion 32 having the first ribs 36*a* and the second ribs 36*b*, the above-described effect of the repulsion performance of a hit ball can be stably exhibited.

When the racket 10 is continuously used, a load is applied to the cylinder portions 32 by replacing the string 21 a plurality of times, but it is possible to suppress the crushing deformation of the first ribs 36*a* themselves even with respect to the load. Thus, it is possible to obtain the above-described effect of the repulsion performance of a hit ball over a long period of time.

Further, since the cylinder portion 32 has the plurality of ribs 36, and the ribs 36 are formed to have the same length as the cylinder main body 35 and extend to a position protruding inward from the inner peripheral surface 20*c* of the frame 20, the rigidity of the cylinder portion 32 can be improved by the ribs 36. Such an improvement in the rigidity of the cylinder portion 32 also makes it difficult for the cylinder portion 32 to be deformed when a ball is hit by the racket 10, and the above-described effect of the repulsion performance of a hit ball can be obtained.

Since the main string 21 serving as the warp threads has a large influence on the hitting performances including the repulsion performance, the first ribs 36*a* and the second ribs 36*b* are formed with respect to the cylinder portions 32 through which the main string 21 serving as the warp threads is inserted, whereby the above-described effects can be efficiently exhibited. Further, since the first ribs 36*a* and the second ribs 36*b* are formed in the cylinder portions 32 through which the string 21 passing through the central region S is inserted, the above-described effects can be more efficiently exhibited.

Since the cylinder portions 32 through which the cross string 21 serving as the weft threads is inserted on both sides in the lateral direction of the frame 20 is configured not to have the rib 36, there is a possibility that the repulsion performance or the like is suppressed. However, the cross string 21 of the weft threads largely contributes to the feeling of ball hitting as compared with the repulsion performance, and the racket 10 can be structured to exhibit well-balanced performance as a whole in combination with the repulsion performance of the main string 21 of the warp threads and the cylinder portions 32 having the ribs 36.

Note that the present invention is not limited to the above-described embodiment, and may be carried out with various modifications. In the above-described embodiment, the size, shape, direction, and the like illustrated in the accompanying drawings are not limited thereto, and may be appropriately changed within the scope in which the effect of the present invention is exhibited. In addition, the present invention can be implemented with appropriate modifications without departing from the scope of the object of the present invention.

For example, the rib 36 may be provided in the cylinder portions 32 through which the cross string 21 serving as the weft threads is inserted. In this case, the direction of the cylinder portions 32 through which the main string 21 serving as the warp threads is inserted is changed from the vertical direction to the lateral direction by 90°.

In the cylinder portion 32, two or more of the first ribs 36*a*, for example, three or four of the first ribs 36*a* may be formed on each of both sides in the extending direction of the strip-shaped portion 31 in a single cylinder main body 35. One or more of the second ribs 36*b*, for example, two or three of the second ribs 36*b* may be formed on each of both sides in the direction orthogonal to the extending direction of the strip-shaped portion 31 in a single cylinder main body 35. Therefore, a configuration in which eight ribs 36 are formed at intervals of 45° in the circumferential direction of the cylinder main body 35 can be exemplified.

INDUSTRIAL APPLICABILITY

The present invention relates to a grommet capable of improving the repulsion performance when a ball is hit by a racket, and a racket using the grommet.

The present application is based on Japanese Patent Application No. 2021-012755 filed on Jan. 29, 2021, the contents of which are incorporated herein in their entirety.

The invention claimed is:

1. A racket, comprising:

a grommet that includes a strip-shaped portion extending in a predetermined direction and cylinder portions that protrude from one surface of the strip-shaped portion; and a loop-shaped frame on which a string is extended in a tensioned state in a vertical direction and a lateral direction, wherein each of the cylinder portions is received within a respective hole formed in the frame so as to mount the grommet on the frame, and the string extends through each of the cylinder portions so as to be maintained in the tensioned state, wherein at least one of the cylinder portions comprises:

a cylinder main body through which the string extends in a state in which the cylinder main body is positioned in the respective hole formed in the frame, ribs formed on an outer peripheral surface of the cylinder main body, wherein the ribs protrude outwardly from the outer peripheral surface and extend along an extending direction of a central axis of the cylinder main body, the ribs including first ribs that protrude from the outer peripheral surface of the cylinder main body at an incline and generally in an extending direction of the strip-shaped portion, and the ribs including second ribs that protrude from the outer peripheral surface of the cylinder main body in a direction orthogonal to the extending direction of the strip-shaped portion, at least two of the first ribs are formed on each of first opposing curved face regions of the outer peripheral surface of the cylinder main body, at least one of the second ribs is formed on each of second opposing curved face regions of the outer peripheral surface of the cylinder main body, and a tip end of each of the ribs, in respective protruding directions of the ribs, contacts an inner peripheral surface of the respective hole formed in the frame.

2. The racket according to claim 1, wherein the first ribs are constituted by two first ribs formed on each of the first opposing curved face regions of the outer peripheral surface of the cylinder main body, and the second ribs are constituted by one second rib formed on each of the second opposing curved face regions of the outer peripheral surface of the cylinder main body.

3. The racket according to claim 1, wherein the at least one of the cylinder portions having the ribs comprises a cylinder portion located at a central region of the frame.

* * * * *